United States Patent [19]

Kushima et al.

[11] Patent Number: 4,839,683

[45] Date of Patent: Jun. 13, 1989

[54] AUTOMATIC IMAGE DEVELOPING APPARATUS

[75] Inventors: Hiroshi Kushima; Hideo Ishizaka, both of Kanagawa, Japan

[73] Assignee: Fuji Photo Film Co., Ltd., Kanagawa, Japan

[21] Appl. No.: 59,301

[22] Filed: Jun. 8, 1987

[30] Foreign Application Priority Data

Jun. 6, 1986 [JP] Japan ..... 61-131338

[51] Int. Cl.[4] ..... G03D 3/02; G03D 3/08

[52] U.S. Cl. ..... 354/322; 354/325; 354/339

[58] Field of Search ..... 354/320, 321, 322, 324, 354/325, 338, 339; 134/64 P, 122 P

[56] References Cited

U.S. PATENT DOCUMENTS

| | | | |
|---|---|---|---|
| 3,463,073 | 8/1969 | Knibiehly | 134/122 P |
| 3,593,642 | 7/1971 | Becheiraz et al. | 134/122 P |
| 4,034,389 | 7/1977 | Huss | 354/322 |
| 4,174,901 | 11/1979 | Takita et al. | 354/322 |
| 4,190,346 | 2/1980 | Hutson et al. | 354/324 |
| 4,650,308 | 3/1987 | Burbury | 354/322 |

*Primary Examiner*—A. A. Mathews

*Attorney, Agent, or Firm*—Sughrue, Mion, Zinn, Macpeak and Seas

[57] ABSTRACT

An automatic image developing apparatus for automatically developing an image recorded on a photographic photosensitive material includes a feeder assembly for feeding the photographic photosensitive material successively to processing tanks for developing the image, fixing the developed image, and washing the photographic photosensitive material. The feeder assembly has at least one conduit for supplying cleaning water to remove processing solutions from the feeder assembly. The conduit has small holes or slits defined in its outer peripheral wall for ejecting cleaning water against guide plates and rollers of the feeder assembly.

5 Claims, 3 Drawing Sheets

10
12
14
16
18
20
22
23
24
26
28
30
32
34
36
40a
40b
42a
42b
48
50
52
54
56
60a
60b
62a
62b
64
66
68
69
70
71
72
74a
74b
76a
76b
78a
78b
80
82
84
A

AUTOMATIC IMAGE DEVELOPING APPARATUS

BACKGROUND OF THE INVENTION

The present invention relates to an automatic image developing apparatus, and more particularly to an automatic image developing apparatus arranged for automatically cleaning a feeder assembly which feeds a photographic photosensitive material with an image recorded thereon successively through processing tanks which develop and fix the image and then wash the material.

There has recently been developed and widely used especially in the medical field a radiation image recording and reproducing system for producing the radiation-transmitted image of an object using a stimulable phosphor material capable of emitting light upon exposure to stimulating rays. When a certain phosphor is exposed to a radiation such as X-rays, $\alpha$-rays, $\beta$-rays, $\gamma$-rays, cathode rays, or ultraviolet rays, the phosphor stores a part of the energy of the radiation. When the phosphor exposed to the radiation is subsequently exposed to stimulating rays such as visible light, the phosphor emits light in proportion to the stored energy of the radiation. The phosphor exhibiting such a property is referred to as a "stimulable phosphor".

In the radiation image recording and reproducing system employing such a stimulable phosphor, the radiation image information of an object such as a human body is stored in a sheet having a layer of stimulable phosphor, and then the stimulable phosphor sheet is scanned with stimulating rays such as a laser beam to cause the stimulable phosphor sheet to emit light representative of the radiation image. The emitted light is then photoelectrically detected to produce an image information signal that is electrically processed for generating image information which is recorded as a visible image on a recording medium such as a photographic photosensitive material or displayed as a visible image on a CRT or the like.

The radiation image information stored in the stimulable phosphor sheet may permanently be recorded on a recording medium by an image recorder such as an image output laser printer, for example. In the image output laser printer, photographic films stored as a recording material in a magazine are loaded, and taken out one by one by a sheet delivery or feeding mechanism such as a suction cup. Thereafter, the film is exposed to a laser beam modulated by an image signal produced from the stimulable phosphor sheet for recording an image on the film.

The film on which the image is newly recorded is then delivered into an automatic image developing apparatus. In the automatic image developing apparatus, the film is first fed into a developing tank containing an image developing solution to develop the image, then passed through a fixing tank containing an image fixing solution to fix the developed image, and thereafter fed into a water tank containing washing water, or washing water is applied to the film as by spraying, to wash the film.

Then, the film is moved between rollers or the like in a squeezer unit to squeeze out washing water, and thereafter delivered into a drier unit in which hot air at a temperature of about 55° C. is applied to the film to dry the same. Subsequently, the film is stored in a prescribed place for use in medical diagnosis, if required.

The image developing solution, the image fixing solution, and the washing water are stored in the respective tanks in the automatic image developing apparatus, as described above. A feeder assembly is disposed between the tanks for feeding the film into developing, fixing, and washing units. The feeder assembly comprises, for example, racks composed of rollers and guide plates. When the film is delivered by the feeder assembly into the tanks, the solutions are applied to the racks. If the applied solutions were left attached to the rollers and guide plates for a long period of time, the solutions would be oxidized or solidified, and the oxidized or solidified deposits would be applied to films that are subsequently passed through the tanks, resulting in processing irregularities. Therefore, it is necessary to clean the racks periodically to remove such objectionable deposits.

To clean the feeder assembly, the worker must disassemble the automatic image developing apparatus or remove the feeder assembly from the automatic image developing apparatus, after which the racks must be manually cleaned. The feeder assembly needs relatively frequent cleaning. Accordingly, the cleaning operation is considerably burdensome for the worker and also time-consuming.

SUMMARY OF THE INVENTION

It is a primary object of the present invention to provide an automatic image developing apparatus including a feeder assembly for feeding a photographic photosensitive material successively to developing, fixing, and washing tanks, the feeder assembly having conduits for ejecting cleaning water against racks composed of rollers and guide plates to remove processing solutions off the racks, so that the feeder assembly will automatically be cleaned.

Another object of the present invention is to provide an automatic image developing apparatus for automatically developing an image recorded on a photographic photosensitive material, the apparatus including a feeder assembly for feeding the photographic photosensitive material successively to processing tanks for developing the image, fixing the developed image, and washing the photographic photosensitive material, the feeder assembly having at least one conduit for supplying cleaning water to remove processing solutions from the feeder assembly.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
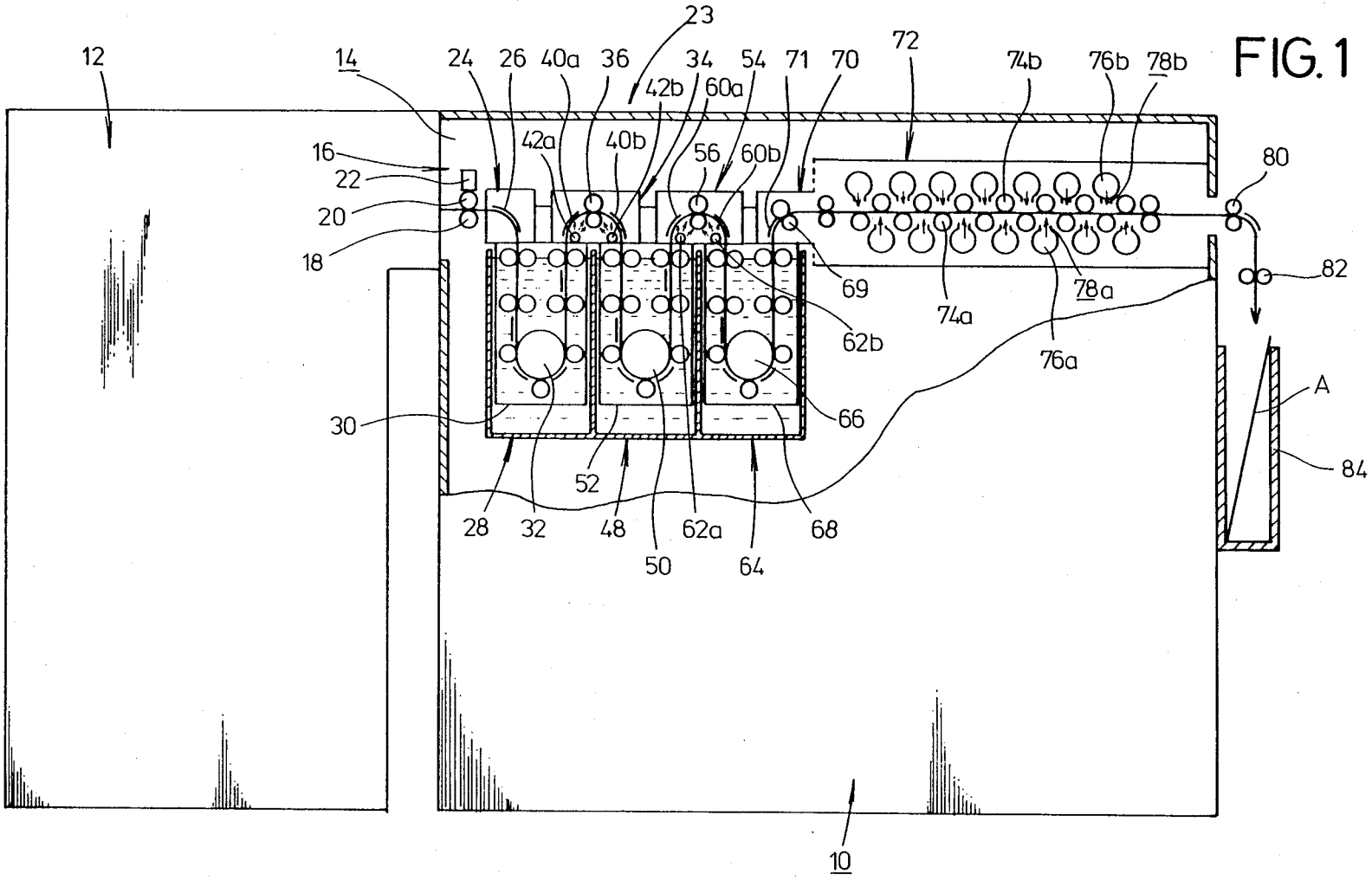
FIG. 1 is a partly cross-sectional view of an automatic image developing apparatus according to the present invention.

Referring to FIG. 1, the reference numeral 10 generally designates an automatic image developing apparatus according to the present invention, which is associated with an image recording apparatus 12. An unexposed film loaded in the image recorder 12 is scanned with a light beam such as a laser beam to record an image on the film, after which the film is delivered by a film delivery mechanism (not shown) into the automatic image developing apparatus 10.

The automatic image developing apparatus 10 has an film inlet slot 14 communicating with a film outlet port (not shown) of the image recording apparatus 12. A film detector 16 is disposed closely to the film inlet port 14. The film detector 16 comprises an inserter roller 18, a detector roller 20 disposed above the inserter roller 18, and a microswitch 22 operatively coupled to the detector roller 20. The detector roller 20 is movable upwardly when a film A delivered from the image recording apparatus 12 via the film inlet port 14 is inserted between the inserter roller 18 and the detector roller 20. The microswitch 22 is actuated by such upward movement of the detector roller 20 to detect when one film A is inserted between the inserter roller 18 and the detector roller 20.

A first rack 24 which constitutes a portion of a feeder assembly 23 is disposed near the film detector 16. The first rack 24 includes a curved guide plate 26 for directing the film A as it has passed through the film detector 16 into an image developing unit 28 while deflecting the path of travel of the film A through 90°.

The image developing unit 28 has a tank 30 storing an image developing solution. An image developing rack 32 composed of a plurality of rollers and a plurality of guide plates is positioned in the tank 30. The feeder assembly 23 also includes a second rack 34 positioned at the terminal end of the image developing rack 32 and including a pair of rollers 36, a pair of curved guide plates **40*a*, 40*b*, and a pair of rack cleaning conduits 42*a*, 42*b*** such as pipes.

Figure 2:
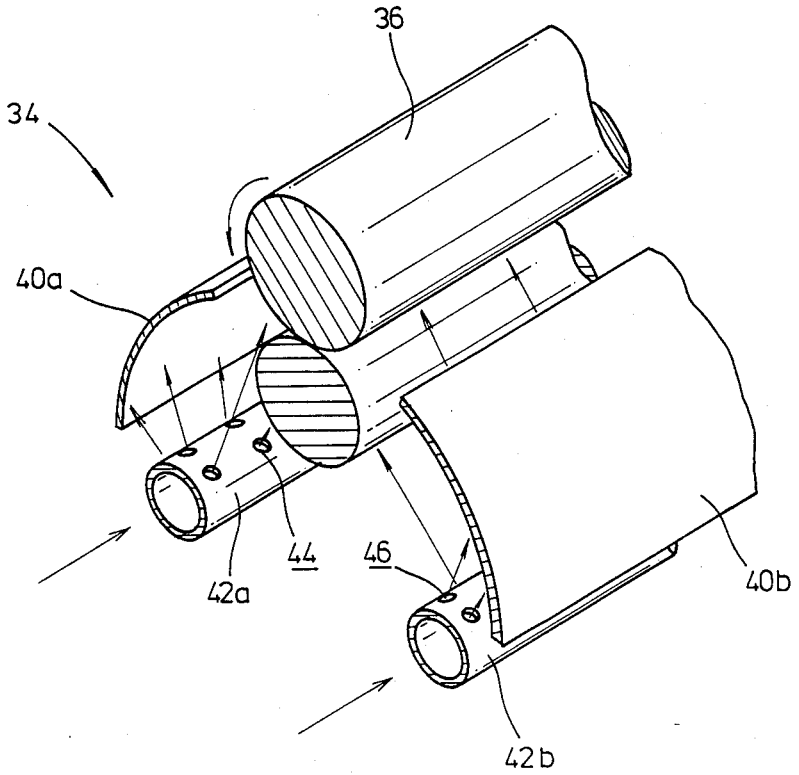
FIG. 2 is a fragmentary perspective view of rollers, guide plates, and a cleaning water ejecting mechanism in the automatic image developing apparatus.

As shown in FIGS. 1 and 2, the conduit **42*a* is disposed near the guide plate 40*a* and the rollers 36 and has a plurality of small holes 44 defined through its outer peripheral wall and directed toward the guide plate 40*a* and the rollers 36. The conduit 42*a* is disposed near the guide plate 40*b* and the rollers 36 and has a plurality of small holes 46 defined through its peripheral wall and opening toward the guide plate 40*b* and the rollers 36. The conduits 42*a*, 42*b* are coupled through a solenoid-operated valve (not shown) to a cleaning water supply conduit (not shown) connected to a water washing unit 64 (described later). In response to switching operation of the solenoid-operated valve, a portion of film washing water is selectively ejected from the holes 44, 46 toward the rollers 36 and the guide plates 40*a*, 40*b***.

At the outlet end of the second rack 34, there is positioned an image fixing unit 48 including an image fixing rack 50 composed of a plurality of rollers and guide plates. The image fixing rack 50 is immersed in an image fixing solution stored in a tank 52 and has a terminal end connected to a third rack 54.

The third rack 54 has a pair of rollers 56, a pair of curved guide plates **60*a*, 60*b*, and a pair of rack cleaning conduits 62*a*, 62*b*. The conduits 62*a*, 62*b* are of the same construction as that of the conduits 42*a*, 42*b*. Thus, upon operation of a solenoid-operated valve (not shown), cleaning water is ejected from the holes of the conduits 62*a*, 62*b* into the third rack 54**.

The water washing unit 64 has a water washing rack 66 positioned at the outlet end of the third rack 54 and immersed in washing water stored in a tank 68. The water washing rack 66 has its terminal end coupled to a squeezer unit 70. The squeezer unit 70 has a pair of rollers 69 and a guide plate 71 for feeding the film A which has been delivered upwardly from the water washing unit 64 toward a drier unit 72 while deflecting the film A through 90°.

The drier unit 72 comprises a group of rollers **74*a* positioned for contact with one surface of the film A, and a group of rollers 74*b* positioned for contact with the opposite surface of the film A, the rollers 74*a*, 74*b* being horizontally alternate with each other. The drier unit 72 also includes a plurality of air discharge conduits 76*a* disposed adjacent to the rollers 74*a* in confronting relation to the rollers 74*b*, respectively, and a plurality of air discharge conduits 76*b* disposed adjacent to the rollers 74*b* aaaconfronting relation to the rollers 74*a*, respectively. The air discharge conduits 76*a*, 76*b* have drying air discharge slits 78*a*, 78*b* defined therein for ejecting hot air toward the film A as it is fed between the roller groups 74*a*, 74*b***.

A pair of rollers 80 is positioned at the outlet end of the drier unit 72, and another pair of rollers 82 is located downwardly of the rollers 80. A film storage unit 84 is disposed below the rollers 82.

Operation and advantages of the automatic image developing apparatus of the above construction will be described below.

A film A on which an image has been recorded by the image recording apparatus 12 is delivered by the film delivery mechanism into the automatic image developing apparatus 10 via the film inlet port 14 and the film detector 16.

Upon passage of the film A through the film detector 16, the microswitch 22 is turned on to indicate that the film A has entered the automatic image developing apparatus 10. The film A which has passed through the film detector 16 is then directed by the first rack 24 downwardly upon operation of a developing unit controller (not shown). The film A is gripped by the image developing rack 32 while being immersed in the image developing solution in the tank 30. The film A is then deflected 180° in the tank 30 toward the second rack 34. The film A having reached the second rack 34 is deflected 180° again by the guide plates **40*a*, 40*b* and the rollers 36 toward the image fixing rack 50 where the film A is immersed in the image fixing solution contained in the tank 52 of the image fixing unit 48. The film A is thereafter fed upwardly toward the third rack 54 and then directed downwardly by the guide plates 60*a*, 60*b* and the rollers 56 through the water washing rack 66 into the tank 68 of the water washing unit 64, in which the film A is washed by water. After having been washed, the film A is delivered to the squeezer unit 70 where water on the film A is squeezed out. Thereafter, the film A is introduced into the drier unit 72**.

In the drier unit 72, the film A is fed along with its opposite surfaces being held in contact with the rollers **74*a*, 74*b*. On travel through the driver unit 72, hot air at about 55° C. is ejected from the slits 78*a*, 78*b* of the air discharge conduits 76*a*, 76*b* toward the surfaces of the film A to evaporate any remaining water thereon. The film A is then delivered by the rollers 80, 82 into the film storage unit 84. When the film A is finally stored in the film storage unit 84**, the image on the film A is fully developed and the film A is appropriately dried.

The racks 34, 54 are positioned in association with the tanks 30, 52, respectively. Therefore, the film A with the image developing and fixing solutions attached thereto is delivered into the racks 34, 54. As the film A passes through the racks 34, 54, the image developing and fixing solutions are attached to the racks 34, 54. Therefore, it is necessary to clean the racks 34, 54 to remove the attached deposits of the image developing and fixing solutions. A process of cleaning the second rack 34, for example, will be described below.

First, delivery of a film A into the automatic image developing apparatus 10 is stopped, and the non-illustrated solenoid-operated valve is actuated to supply cleaning water to the conduits 42*a*, 42*b*. The cleaning water introduced into the conduit 42*a* is ejected out of the holes 44 of the conduit 42*a* against the guide plates 40*a* and the rollers 36 which are positioned closely to the conduit 42*a*. The cleaning water introduced into the conduit 42*b* is ejected out of the holes 46 of the conduit 42*b* against the guide plates 40*b* and the rollers 36 which are positioned closely to the conduit 42*b*. Therefore, the guide plates 40*a*, 40*b* and the rollers 36 can be cleaned by the cleaning water thus ejected. As a result, the attached deposits of solutions can automatically and efficiently be removed from the guide plates 40*a*, 40*b* and the rollers 36 by the cleaning water supplied from the conduits 42*a*, 42*b* without disassembling the automatic image developing apparatus 10. During this time, the rollers 36 may be rotated to allow the cleaning water to be supplied reliably over the entire peripheral surfaces of the rollers 36, so that the second rack 34 can be cleaned more effectively.

The first rack 54 can similarly be cleaned by the cleaning water ejected from the conduits 62*a*, 62*b* against the guide plates 60*a*, 60*b* and the rollers 56.

Figure 3:
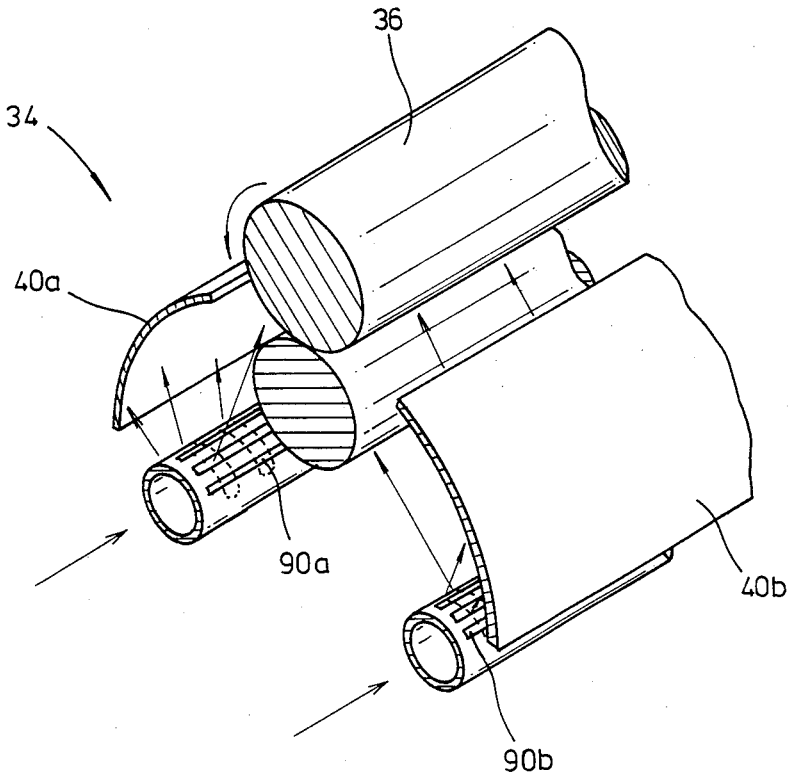
FIG. 3 is a fragmentary perspective view of rollers, guide plates, and a cleaning water ejecting mechanism according to another embodiment of the present invention.

In the above embodiment, the small holes 44, 46 are defined in the rack cleaning conduits 42*a*, 42*b* and 62*a*, 62*b*. However, slits may be defined in the outer peripheral walls of these conduits for ejecting cleaning water, as shown in FIG. 3. More specifically, rack cleaning conduits 42*a*, 42*b* and 62*a*, 62*b* have slits 90*a*, 90*b*, respectively, which may extend along the axes of the conduits 42*a*, 42*b* and 62*a*, 62*b* as indicated by the solid lines or may extend circumferentially over a certain angular range as indicated by the dotted lines.

While in the above embodiments the conduits 42*a*, 42*b* and 62*a*, 62*b* are supplied with the cleaning water via the solenoid-operated valve to the cleaning water supply conduit coupled to the water washing unit 64, the washing water stored in the tank 68 of the water washing unit 64 may be supplied by a pump to the conduits 42*a*, 42*b* and 62*a*, 62*b*.

With the arrangement of the present invention, as described above, a feeder assembly for feeding a photographic photosensitive material to each processing tank includes rack cleaning conduits from which cleaning water can be supplied to remove processing solution deposits from a rack. Therefore, the feeder assembly which has conventionally been manually cleaned by the operator can automatically be cleaned within a short period of time. The feeder assembly which needs frequency cleaning can be cleaned by a simplified process, and hence the automatic image developing apparatus can efficiently be operated.

Although certain preferred embodiments have been shown and described, it should be understood that many changes and modifications may be made therein without departing from the scope of the appended claims.

What is claimed is:

1. An automatic image developing apparatus for automatically developing an image recorded on a photographic photosensitive material, said apparatus comprising a feeder assembly for feeding the photographic photosensitive material successively to processing tanks for developing the image, fixing the developed image, and washing the photographic photosensitive material, said feeder assembly having at least one conduit for supplying cleaning water to remove processing solutions from the feeder assembly, said conduit being disposed near said feeder assembly and having openings defined in an outer peripheral wall thereof for ejecting the cleaning water therethrough against said feeder assembly to clean said assembly, wherein said feeder assembly and said conduit are exterior to said processing tanks, and wherein said feeder assembly comprises at least one guide plate and a pair of rollers, the conduit being positioned such that said cleaning water is ejected on said at least one guide plate and said pair of rollers simultaneously.

2. An automatic image developing apparatus according to claim 1, wherein said openings of said conduit comprise a plurality of small holes opening toward said guide plate and said rollers.

3. An automatic image developing apparatus according to claim 1, wherein said openings of said conduit comprise a plurality of slits opening toward said guide plate and said rollers.

4. An automatic image developing apparatus according to claim 3 wherein said slits are defined in the outer peripheral wall of said conduit and extending along an axis thereof.

5. An automatic image developing apparatus according to claim 3, wherein said slits are defined in the outer peripheral wall of said conduit and extending circumferentially thereof.

* * * * *